US005911620A

United States Patent [19]

Spangenberg et al.

[11] Patent Number: 5,911,620

[45] Date of Patent: Jun. 15, 1999

[54] POT-SHAPED GRINDING WHEEL

[75] Inventors: Rolf Spangenberg, Gauting; Josef Nussbaumer, Augsburg, both of Germany

[73] Assignee: Hilti Aktiengesellschaft, Schaan, Liechtenstein

[21] Appl. No.: 09/027,863

[22] Filed: Feb. 23, 1998

[30] Foreign Application Priority Data

Feb. 25, 1997 [DE] Germany ..... 197 07 445

[51] Int. Cl.[6] ..... B24D 7/06

[52] U.S. Cl. ..... 451/548; 451/540

[58] Field of Search ..... 451/548, 540, 451/550

[56] References Cited

U.S. PATENT DOCUMENTS

| | | | |
|---|---|---|---|
| 970,618 | 9/1910 | Gardner | 451/548 |
| 2,307,312 | 1/1943 | Whiting | 51/209 |
| 2,307,632 | 1/1943 | Meyer | 51/209 |
| 2,749,681 | 6/1956 | Reidenbach | 51/195 |
| 3,745,719 | 7/1973 | Oswald | 51/209 |
| 3,754,355 | 8/1973 | Hanchett | 51/209 |
| 4,212,137 | 7/1980 | Rue | 51/206.4 |
| 4,246,004 | 1/1981 | Busch et al. | 51/295 |
| 5,454,752 | 10/1995 | Sexton et al. | 451/548 |

*Primary Examiner*—David A. Scherbel
*Assistant Examiner*—Dung Van Nguyen
*Attorney, Agent, or Firm*—Anderson, Kil & Olick, P.C.

[57] ABSTRACT

A pot-shaped grinding wheel having a circular grinding region provided with a plurality of segment-like grinding members (5), a circular seat region (4) coaxial with an axially spaced from the grinding region (2), a transition region (3) extending between an inner contour of the grinding region (2) and an outer contour of the seat region (4) and tapering toward the outer contour of the seat region (4), and at least one bore (6) extending parallel to an axis of the grinding wheel and arranged in the grinding region (2) and at least one bore (7) likewise extending parallel to the grinding wheel axis and arranged in the transition region (3).

6 Claims, 1 Drawing Sheet

POT-SHAPED GRINDING WHEEL

BACKGROUND OF THE INVENTION

1. Field of the Invention

The present invention relates to a pot-shaped grinding wheel including a circular grinding region provided with a plurality of segment-like grinding members, a circular seat region coaxial with and axially spaced from the grinding region, a transition region extending between an inner contour of the grinding region and an outer contour of the seat region, and at least two bores extending parallel to an axis of the grinding wheel.

2. Description of the Prior Art

For grinding outer surfaces of mineral constructional components and constructional components provided with a coating layer, a pot-shaped grinding wheel such as disclosed, e.g., in European Publication EP 0 535 431, is used. The grinding wheel is mounted on an manual angle grinder which, as a rule, is connected with a suction system including a suction hood and a suction device. The pot-shaped grinding wheel is particularly used for eliminating unevenness on stones and coated concrete surfaces and for finishing of facades.

During grinding of a surface, the grinding wheel is displaced along the surface in such a manner that at least a portion of the grinding member, which is located remotely from the grinding wheel seat region, is removed, together with the material of the constructional component. These materials, together with the sand dust, is removed through the bores in the grinding wheel by the suction system from the work region. The bores, which are provided in the grinding wheel, are so arranged that each bore lies partially in the grinding region and partially in the transition region. Because of the conical shape of transition region, the bores open not only into side surface of the grinding region, which is remote from the seat region, but also into a free space which lies between the seat and grinding region and which surrounds the transition region. Therefore, upon actuation of the suction system, first, the air from this free space should be aspirated until a partial vacuum is formed between the grinding region and the ground surface. This presents, in particular, an inconvenience for the operator because the creation of the partial vacuum always delays the start of the grinder and, therefore, the suction of the waste material and of the sand dust cannot be effected at the very beginning of the grinding process. A further drawback of the known grinding wheel consists in that a suction nipple of the suction hood can be superimposed only with one bore. Therefore, the necessary, for suction, vacuum is always provided only through a bore with a superimposed hood nipple. Because the remaining bores form in the transition region passages through which air can penetrate into the free space, it is practically impossible to form a necessary vacuum in the free space, which surrounds the transition region, and between the grinding region and the ground surface of the constructional component.

An object of the present invention is a grinding wheel, which would have a simple construction and could be economically produced and which would insure a rapid a reliable aspiration of the removable material and the sand dust from the work region. The grinding wheel should insure a good grinding performance, good quality of the ground surface of the constructional component, and good cooling of the grinding members. The grinding wheel should not generate any vibrations and should prevent accumulation of the removable material and the sand dust between the grinding members. Further, the construction of the grinding wheel should provide for rapid creation of the necessary vacuum between the grinding region and the surface of a constructional component.

SUMMARY OF THE INVENTION

These and other objects of the present invention, which will become apparent hereinafter, are achieved by forming at least one bore in the grinding region and at least one bore in the transition region of the grinding wheel. Because the bore which is formed in the grinding regions, open only into a side of the grinding regions remote from the seat region, a rapid creation of a high vacuum between the grinding region and the precessed surface becomes possible, and the removable material is aspirated almost immediately. Through the bore formed in the transition region, the remaining removable material and the formed sand dust are removed from the work region.

A long service life of the grinding wheel is insured by its appropriate cooling. Because the grinding members of the grinding disc are segment-like, they do not completely overlie the processed surface. Intermediate spaces, which are formed between the grinding members and extend from the outer contour of the grinding region through an entire radical extent of the grinding region, provide for flow therethrough of the outside air the temperature of which is lower than the temperature of the grinding members during grinding of a constructional component. The cooling air surrounds the grinding members cooling the same. Thereby, the thermal load, to which the grinding members and adhesive means which provides for attachment of the grinding members to the grinding which are subjected, is reduced.

In particular, large particles of the removable material should be aspirated as soon as possible so that they would not cause any damage of the ground surface. To this end, the bores in the grinding region are advantageously made larger than the bores in the transition region.

In order for the vacuum, which is generated by the suction system, be formed mainly in the grinding region, advantageously, the diameter of the bores, which are provided in the grinding region, exceeds the diameter of the bores, which are formed in the transition region, in 1.5–3.6 times.

To insure an appropriate rigidity of the grinding wheel, advantageously, the diameter of the bores, which are formed in the grinding region, corresponds to 0.06–0.18 times of the outer diameter of the grinding region.

Advantageously, each grinding member is located, at least partially, between two adjacent bores formed in the grinding region. This, on one hand, provides for a larger grinding surface and, on the other hand, results in formation of chambers which are open toward the center of the grinding wheel and surround, at least partially, the bores formed in the grinding region, and in which the removable material is accumulated which results in better aspiration of the removable material.

During the grinding process, the removable material primarily is aspirated through the bores formed in the grinding region. Because of the rotation of the grinding wheel, the non-aspirated residual removable material is better aspirated through the bores formed in the transition region when the transition region bores trail the bores, which are formed in the grinding regions, in the rotational direction. This is achieved when the bores formed in the transition region are offset relative to the bores formed in the grinding region in the circumferential direction. At that, advantageously the axes of the bores formed in the grinding region lie, respectively, on first rays leading from the grinding wheel axis, with the bores formed in the transition regions lying on respective second rays likewise leading from the grinding wheel axis, and with associated respective first and second axis forming together an angle of 5–25°.

In order for the residual removable material and the sand dust to be adequately aspirated through the bores formed in the transition region, the transition region tapers toward the grinding wheel axis at an angle of about 30–50°.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
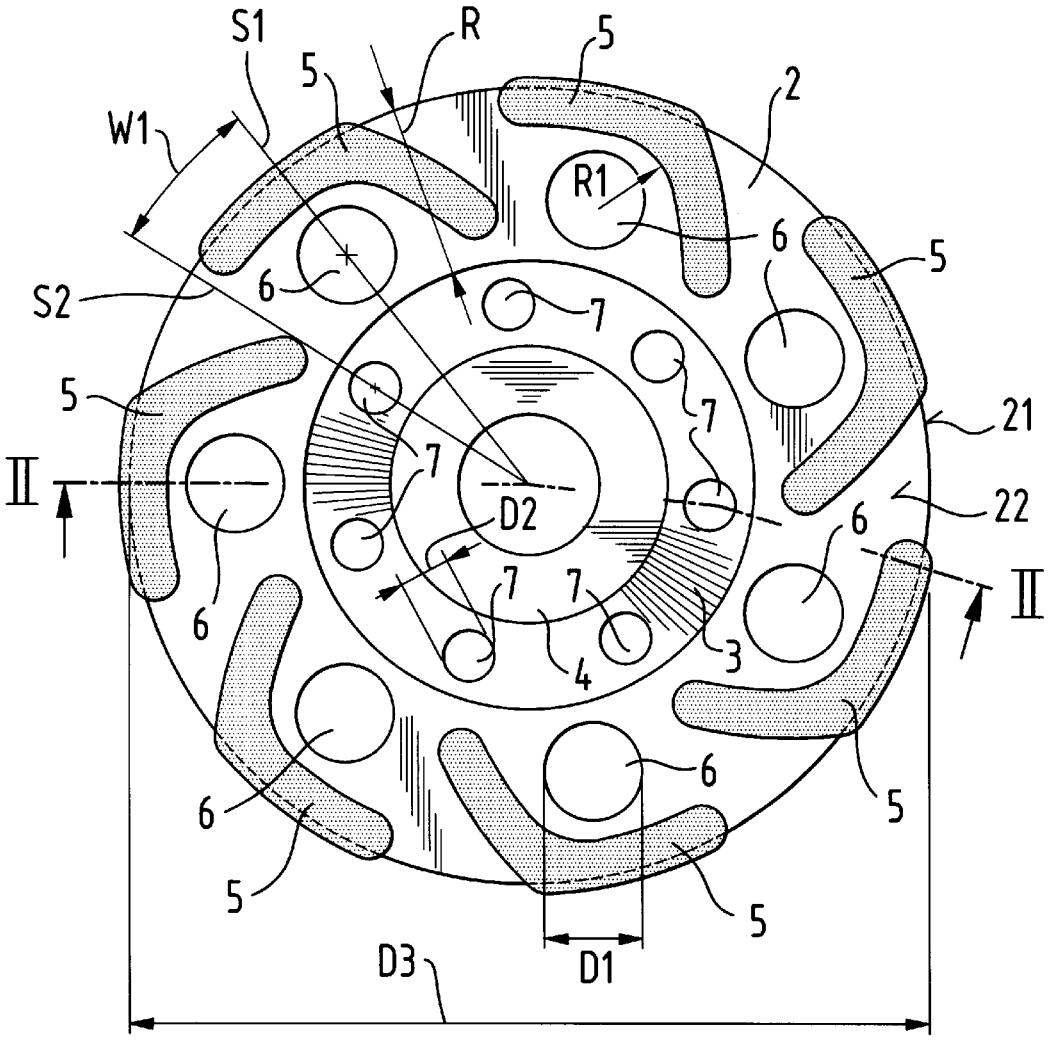
FIG. 1 is a bottom view of a pot-shaped grinding wheel according to the present invention.
Figure 2:
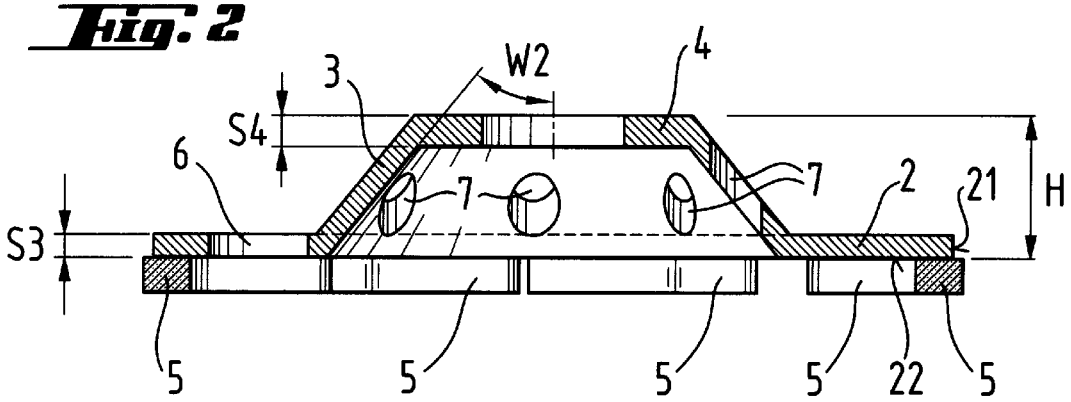
FIG. 2 is a cross-sectional view along line II—II of the grinding wheel shown in FIG. 1.

A pot-shaped grinding wheel according to the present invention, which is shown in FIGS. 1–2, has a circular grinding region 2 including a plurality of grinding members 5, a circular seat or locating region 4, and a transition region 3 extending at an angle toward an outer contour of the seat region 4. The seat region 4 serves for mounting the grinding wheel on a driving shaft on an angle grinder (not shown). In order to be mounted on the drive shaft, the inner diameter of the seat region 4 substantially corresponds to the diameter of the drive shaft.

The transition region 3 tapers toward the wheel axis of the grinding wheel extending to the axis at an angle W2 of about 40°. A plurality, e.g., seven bores 7, which extend parallel to the wheel axis, are provided in the circumference of the transition region 3. The bores 7 are spaced from each other by a substantially same distance.

The circular grinding region 2 includes, in the disclosed embodiment, seven bores 6 uniformly arranged along the circumference of the grinding region 2 at a substantially same distance from each other and extending parallel to the grinding wheel axis.

The bores 6, which are formed in the grinding region 2 have a larger diameter than the bores 7 formed in the transition region 3. The diameter D1 of the bores 6 of the grinding region 2 corresponds approximately to 2.10 times of the diameter D2 of the bores 7 of the transition region 3 and equals approximately to 0.13 times of the diameter D3 of the grinding region 2.

The radial extension R of the grinding region 2 is equal approximately to 0.222 times of the diameter D3 of the grinding region 2.

The bores 6, which are formed in the grinding region 2 are offset with respect to corresponding bores 7 formed in the transition region 3 in the circumferential direction. Each axis of bores 6 in the grinding region 2 lies on a first ray S1 extending from the grinding wheel axis, and each axis of bores 7 in the transition region 3 lies on a second ray S2 likewise extending from the grinding wheel axis. The adjacent rays S1 and S2 form an angle W1 of about 20°.

The grinding members 5 are provided on a side surface 22 remote from the seat region 4. The grinding members 5 extend, at least partially, along an outer contour 21 of the circumferential region of the grinding region 2 and project beyond the circumferential region, at least partially, in a radial direction. Each grinding member 5 extends also into a space between two adjacent bores 6 of the grinding region 2, at least partially, along almost an entire radial extension R of the grinding region 2. The grinding members 5 have substantially a L-shape. At that, the geometry of the grinding member 5 is so selected that the grinding member 5 at least partially surrounds a respective bore 6, with an inner contour of the grinding member 5, which extends parallel to the axis of the respective bore 6 and starts at the ray S1, being connected with the inner contour of the portion of the grinding member 5 extending between the respective adjacent bores 6 by a transition region having a radius R1 extending toward the center of the respective bore 6. Such a geometry of the grinding member 5 insures an optimal removal of the grinded material and sanding dust. The geometry of the grinding members 5 and their arrangement eliminates vibrations of the pot-shaped grinding wheel and improves the self-sharpening process of the grinding members 5.

The ratio between the outer diameter of the grinding region 2 and the height H of the grinding wheel between the side surface 22 of the grinding region 2, which is remote from the seat region 4, and the outer side of the seat region 4, remote from the grinding region 2, is approximately 6-1. The thickness S3 of the grinding region 2 of the grinding wheel is smaller than the thickness S4 of the seat region 4. The seat region 4 can have a thickness S4 of 3–6 mm, and the grinding region 2 can have a thickness S3 of 1–2.8 mm. The grinding members 5 are secured to the side surface 22 of the grinding region 2 by appropriate adhesive means.

Though the present invention was shown and described with references to the preferred embodiments, various modification thereof will be apparent to those skilled in the art and, therefore, it is not intended that the invention be limited to the disclosed embodiments or details thereof, and departure can be made therefrom within the spirit and scope of the appended claims.

What is claimed is:

1. A pot shaped grinding wheel, comprising a circular grinding region (2) having an outer contour and an inner contour and provided with a plurality of substantially segment-shaped grinding members (5) circumferentially spaced from each other and projecting partially beyond the outer contour of the grinding region; a circular seat region (4) coaxial with and axially spaced from the grinding region (2) and having an outer contour; a transition region (3) extending between an inner contour of the grinding region (2) and an outer contour of the seat region (4) and tapering toward the outer contour of the seat region (4); at least one bore(s) (6) extending parallel to an axis of the grinding wheel and arranged in the grinding region (2); and at least one bore (7) extending parallel to the axis of the grinding wheel and arranged in the transition region (3).

2. A grinding wheel according to claim 1, wherein the bore (6) provided in the grinding region (2) has a diameter (D1) which is larger than a diameter (D2) of the bore (7) provided in the transition region (3).

3. A grinding wheel according to claim 1, wherein a plurality of equally spaced bores (6) is provided in the grinding region (2), and wherein each of the plurality of the grinding members (5) is arranged, at least partially, between two adjacent bores (6) provided in the grinding region.

4. A pot shaped grinding wheel, comprising a circular grinding region (2) having an inner contour and provided with a plurality of substantially segment-shaped grinding members (5); a circular seat region (4) coaxial with and axially spaced from the grinding region (2) and having an outer contour; a transition region (3) extending between the inner contour of the grinding region (2) and the outer contour of the seat region (4) and tapering toward the outer contour of the seat region (4); at least one bore (6) extending parallel to an axis of the grinding wheel and arranged in the grinding region (2); and at least one bore (7) extending parallel to the axis of the grinding wheel and arranged in the transition region (3), wherein the bore (6) provided in the grinding region (2) has a diameter (D1) which is larger than a diameter (D2) of the bore (7) provided in the transition region (3), and wherein the diameter (D1) of the bore (6) provided in the grinding region (2) is larger than the diameter (D2) of the bore (7) provided in the transition region (3) in 1.5–3.6 times.

5. A pot shaped grinding wheel, comprising a circular grinding region (2) having an inner contour and provided with a plurality of substantially segment-shaped grinding members (5); a circular seat region (4) coaxial with and axially spaced from the grinding region (2) and having an outer contour; a transition region (3) extending between the inner contour of the grinding region (2) and the outer contour of the seat region (4) and tapering toward the outer contour of the seat region (4) and tapering toward the outer contour of the seat region (4); at least one bore (6) extending parallel to an axis of the grinding wheel and arranged in the grinding region (2); and at least one bore (7) extending parallel to the axis of the grinding wheel and arranged in the transition region (3), wherein the bore (6) provided in the grinding region has a diameter equal to 0.06–0.18 times of an outer diameter (D3) of the grinding region (2).

6. A pot shaped grinding wheel, comprising a circular grinding region (2) having an inner contour and provided with a plurality of substantially segment-shaped grinding members (5); a circular seat region (4) coaxial with and axially shaped from the grinding region (2) and having an outer contour; a transition region (3) extending between the inner contour of the grinding region (2) and the outer contour of the seat region (4) and tapering toward the outer contour of the seat region (4); a pluraility of spaced bores (6) extending parallel to an axis of the grinding wheel and arranged in the grinding region (2); and a plurality of spaced bores (7) extending parallel to the axis of the grinding wheel and arranged in the transition region (3);

wherein an axis of each of the plurality of bores (6) provided in the grinding region (2) lies on a first ray (S1) extending from the axis of the grinding wheel, and an axis of each of the plurality of bores (7) is provided in the transition region lies on a second ray (S2) likewise extending from the axis of the grinding wheel and forming with a respective first ray (S1) an angle (W1) from 5° to 25°.

* * * * *